US012276214B1

(12) United States Patent
Baer

(10) Patent No.: US 12,276,214 B1
(45) Date of Patent: Apr. 15, 2025

(54) CAMSHAFT PHASE ADJUSTER WITH IMPROVED VANE CONSTRUCTION

(71) Applicant: RB Distribution, Inc., Colmar, PA (US)

(72) Inventor: Nicholas Baer, Bethlehem, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 18/487,355

(22) Filed: Oct. 16, 2023

(51) Int. Cl.
*F01L 1/344* (2006.01)

(52) U.S. Cl.
CPC ... *F01L 1/3442* (2013.01); *F01L 2001/34479* (2013.01)

(58) Field of Classification Search
CPC ..... F01L 1/3442; F01L 2001/34479
See application file for complete search history.

(56) References Cited

U.S. PATENT DOCUMENTS

| | | | | |
|---|---|---|---|---|
| 6,192,844 | B1 * | 2/2001 | Scheidt | F01L 1/3442 123/90.31 |
| 7,188,596 | B2 * | 3/2007 | Kohrs | F01L 1/3442 123/90.15 |
| 2002/0038637 | A1 * | 4/2002 | Kanada | F01L 1/3442 123/90.15 |
| 2008/0047390 | A1 * | 2/2008 | Kohrs | F01L 1/3442 74/568 R |

* cited by examiner

*Primary Examiner* — Ngoc T Nguyen
(74) *Attorney, Agent, or Firm* — Volpe Koenig

(57) ABSTRACT

A camshaft phase adjuster having a vane construction that optimizes one or more of the seal contact pressure, wear properties, and/or the distribution of forces acting on the vane that are transmitted to the rotor. Vane configurations include vanes with non-parallel sides at the actuation end as well as a core and over-molded cover configuration. This provides enhanced wear properties and/or allows the use of lower strength materials for the vane which reduces costs.

26 Claims, 8 Drawing Sheets

CAMSHAFT PHASE ADJUSTER WITH IMPROVED VANE CONSTRUCTION

BACKGROUND

Camshaft phase adjusters (also known as camshaft phasers) are used to adjust the control times for opening and closing valves of an internal combustion engine. Camshaft phasers are typically arranged in the torque drive path between the crankshaft and the intake and/or exhaust camshaft in order to optimize opening and closing times of intake valves based on engine speed and other variables in order to increase power density, performance and/or reduce fuel consumption.

One known camshaft phaser is vane-cell phaser in which radially extending vanes arranged on a rotor, that is adapted to be fixed to the camshaft, extend between inwardly directed protrusions of a stator that is arranged around the rotor in order to form a plurality of advancing chambers and retarding chambers. The stator is connected to the crankshaft by a timing chain, belt, or gear set. By applying pressurized hydraulic fluid to the advancing chambers, the rotor (and attached camshaft) is rotated in an advancing direction relative to the stator (and the crankshaft) in order to advance the valve timing. By applying pressurized hydraulic fluid to the retarding chambers, the rotor (and attached camshaft) is rotated in a retarding direction relative to the stator (and the crankshaft) in order to retard the valve timing. By applying pressurized hydraulic fluid to both the advancing and the retarding chambers in a modulated manner, the stator and rotor are fixed in position relative to one another within a range of intermediate positions.

Forces applied by the pressurized hydraulic fluid acting on the vanes is transmitted to the rotor by the vanes acting on the sides of grooves in the rotors leading to considerable stresses in the vanes and the rotor at a region where the vanes enter the grooves.

It would be desirable to provide an improved camshaft phaser construction that reduces these stresses, while also providing for ease of manufacture, enhanced wear properties as well as an extended service life.

SUMMARY

The disclosed camshaft phase adjuster embodiments have a vane construction that optimizes one or more of the seal contact pressure, wear properties, and/or the distribution of forces acting on the vane that are transmitted to the rotor. This results in a camshaft phase adjuster with enhanced wear properties. Additionally, some of the constructions allow for the use of lower strength materials for the vane which reduces costs. Further embodiments provide for a resilient element that biases the vane radially outwardly to be made with a greater width than was previously used, which allows for more consistent manufacture within a range of acceptable tolerances, while a further embodiment provides for a vane with an integrated resilient element, ensuring correct assembly.

BRIEF DESCRIPTION OF THE DRAWINGS

Further advantages and characteristics will become apparent by the below description of embodiments making reference to the accompanying drawings, in which.

DETAILED DESCRIPTION

As described herein, embodiments provide a vane construction for a camshaft phase adjuster in which the vane construction optimizes one or more of the seal contact pressure, wear properties, and/or the distribution of forces acting on the vane that are transmitted to the rotor. This provides enhanced wear properties. Further embodiments allow for the use of lower strength materials for the vane which reduces costs. Further embodiments provide for a resilient element, which can be a separate part or integral with the vane, that biases the vane radially outwardly to be made with a greater width than was previously used, which allows for more consistent manufacture within a range of acceptable tolerances.

Certain terminology is used in the following description for convenience only and is not limiting. The words "a" and "one," as used in the claims and in the corresponding portions of the specification, are defined as including one or more of the referenced item unless specifically stated otherwise. The phrase "at least one" followed by a list of two or more items, such as "A, B, or C," means any individual one of A, B or C as well as any combination thereof. The terms approximately or generally mean within +/−10% of a specified value unless otherwise noted, and within +/−10° of a specified angle or direction.

Figure 1:
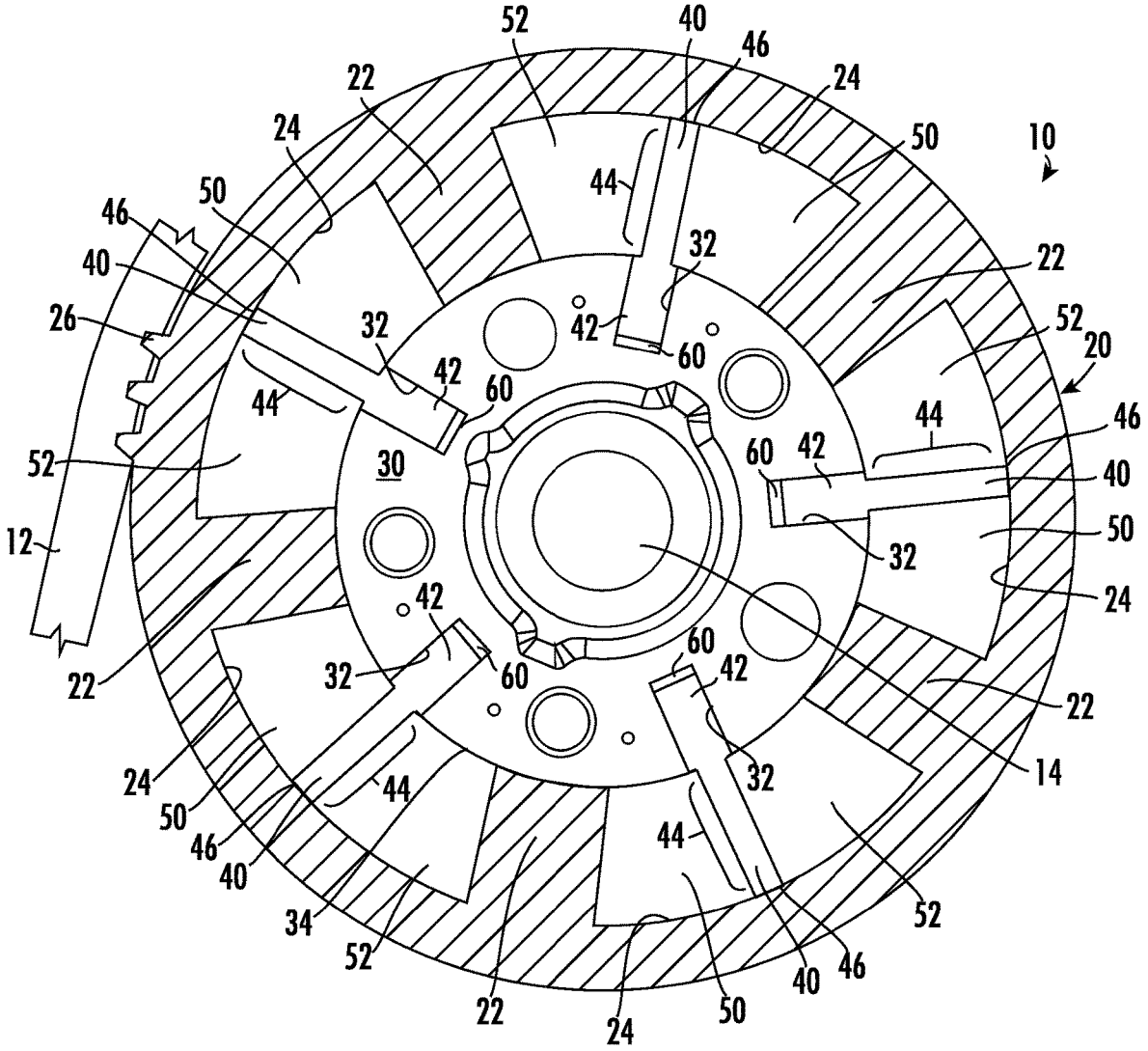
FIG. 1 is a front view of a camshaft phase adjuster in accordance with a first embodiment with the front cover removed in order to show the arrangement of the stator, rotor, and vanes extending from the rotor in order to form advancing and retarding chambers.

Referring to FIG. 1, a first embodiment of a camshaft phase adjuster 10 is shown in a partial section view with the front cover plate removed. The camshaft phase adjuster 10 includes a stator 20 having a plurality of inwardly directed projections 22 that extend from an inner surface 24 toward a rotor 30. An outer surface of the stator 20 is provided with belt or chain teeth 26 in order to be connected in a rotationally fixed manner via a chain or belt 12 to a crankshaft (not shown) of an internal combustion engine. The rotor 30 is located within and rotatable relative to the stator 20. The rotor 30 includes a plurality of grooves 32 that extend radially inwardly from an outer surface 34 of the rotor 30. A plurality of vanes 40 are provided. One of the vanes 40 is located in each respective one of the grooves 32. The vanes 40 contact an inner surface 24 of the stator 20 in locations between the inwardly directed projections 22. The inwardly directed projections 22 of the stator 20 also contact the outer surface 34 of the rotor 30 in order to define a plurality of advancing chambers 50 and a plurality of retarding chambers 52, arranged in pairs on opposite sides of each vane 32. As will be understood by those skilled in the art, the rotor 30 also includes hydraulic fluid passages which can provide pressurized hydraulic fluid to the advancing chambers 50 in order to advance a position of the rotor 30, which is connected to a camshaft, relative to the crankshaft. Supplying pressurized fluid to the retarding chambers 52 retards the position of the camshaft relative to the crankshaft. By applying pressurized hydraulic fluid to both the advancing and retarding chambers 50, 52, the position of the rotor 30 relative to the stator 20 can be hydraulically clamped in order to maintain a specific timing of the camshaft relative to the crankshaft. The advancing or retarding of the camshaft relative to the crankshaft is typically controlled by an engine control module in order to enhance engine performance and/or reduce fuel consumption, depending upon engine operating conditions.

Still with reference to FIG. 1, each of the vanes 40 includes a root 42 that is received in the respective groove 32 and also includes an actuation end 44 that extends radially, outwardly from the groove 32 at the rotor surface 34, with the actuation end 44 being adapted to be acted upon by pressurized fluid in at least one of the advancing or retarding chambers 50, 52, as noted above. The actuation end 44 has a cross-section with reduced stiffness in an area radially, outwardly from the rotor surface 34 in comparison to a stiffness of the root 42 that is received in the groove 32. In the embodiment shown in FIG. 1, this reduced stiffness is achieved by having the root 42 of the vane 40 having a greater thickness in the circumferential direction, preferably by at least about 30%, and more preferably at least 40%, than a thickness of the actuation end 44 of the vane 40 that extends radially, outwardly from the rotor surface 34. This provides two benefits in that the root 42 can have a greater thickness than is typical for known camshaft phase adjuster vanes so that there is less tendency for bending within the area of the groove 32. This helps reduce wear between the groove 32 and the vane 40. Additionally, the greater thickness of the root 42 allows a resilient element 60, such as a spring, located in the groove 32 beneath the vane 40 to have a greater width in comparison to the known arrangements. Having a spring or resilient element 60, typically formed as a bow spring, with a greater width allows for more consistent construction of the spring with a more uniform spring force. This also allows the spring or resilient element 60 to have a reduced thickness in comparison with the known camshaft phase adjusters. The reduced stiffness area at the actuation end 44 of the vane 40 can also allow the use of a material for forming the vane 40 with lower strength requirements.

Figure 2:
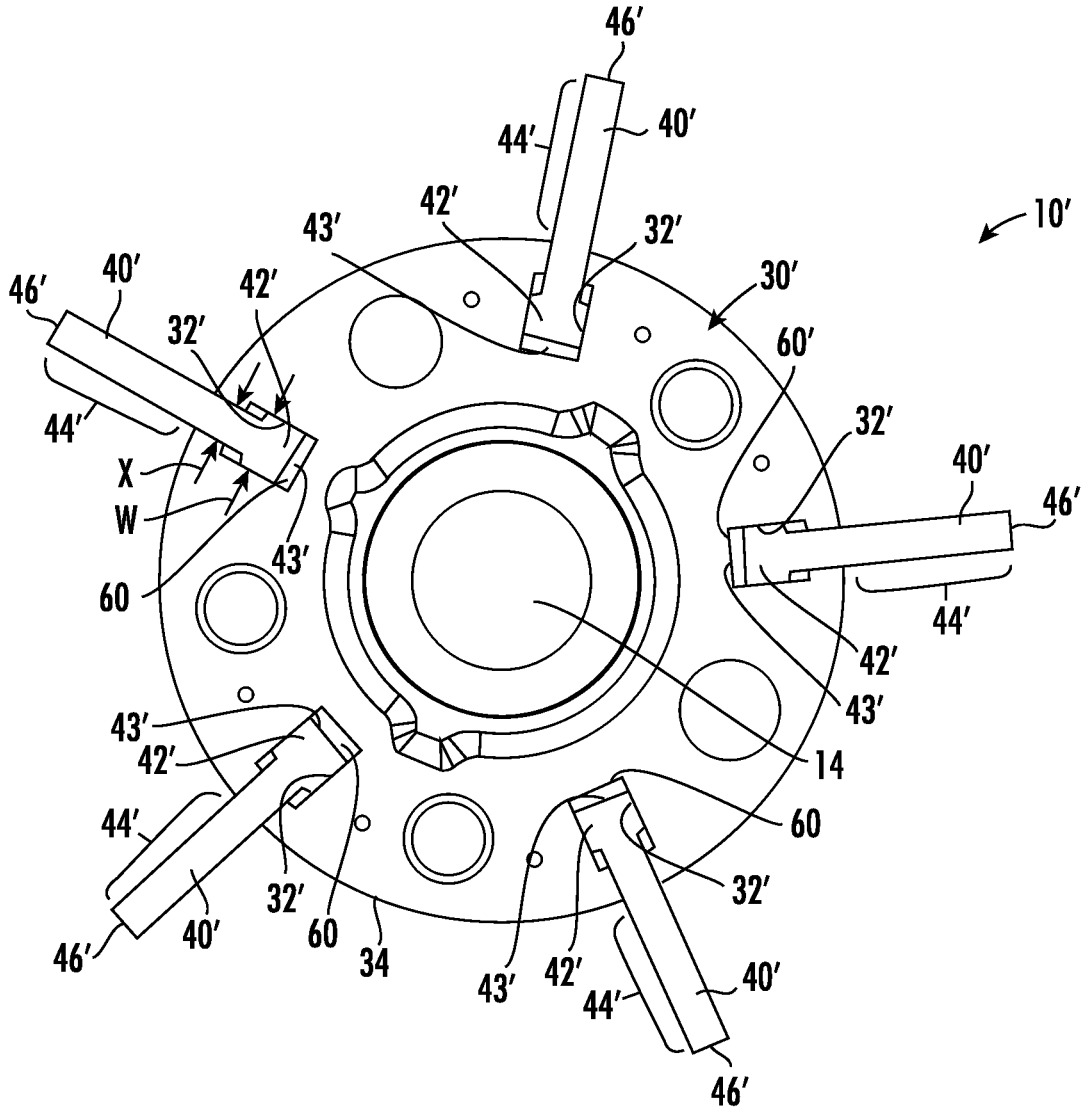
FIG. 2 is a view similar to FIG. 1 of a second embodiment of a camshaft phase adjuster showing only the rotor and vanes.
Figure 3:
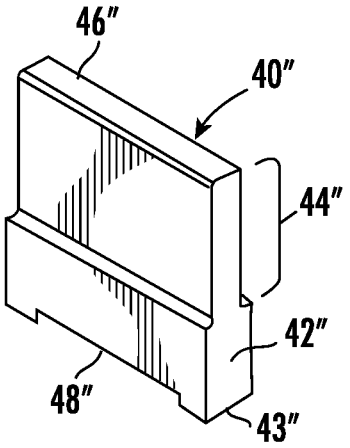
FIG. 3 is a perspective view of a further embodiment of a vane for use in a camshaft phase adjuster.
Figure 4:
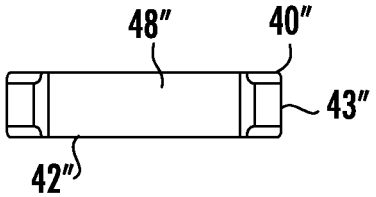
FIG. 4 is a bottom view of the vane shown in FIG. 3.

Referring to FIG. 2, a camshaft phase adjuster 10' is shown. In FIG. 2, the stator is not shown but would be the same as the stator 20 shown in FIG. 1. In FIG. 2, the rotor 30' includes grooves 32' which have a key-hole shape in cross-section. Specifically, the internal portion of the groove 32' has an enlarged groove width W in comparison with the groove width X at the outer surface 34' of the rotor 30'. W may be for example in the range of 4-9 mm, and X may be for example in the range of 3-5 mm. The vanes 40' in this embodiment have a generally constant thickness in the circumferential direction not only in the area that extends radially, outwardly from the rotor surface 34' but also through the narrowed opening in the groove 32'. The base 43' at the root 42' of the vanes 40' is enlarged in thickness, preferably by at least about 30%, and more preferably at least 40% of the thickness of the vanes 40', in the reduced stiffness area at the actuation end 44' that extends radially outwardly from the rotor surface 34'. With this arrangement, the vanes 40' are mechanically retained in the rotor 30' via the grooves 32' having a key-hole shape in cross-section which provides for ease in manufacturing. Further, the actuation end 44' of the vane 40' also has a cross-section with reduced stiffness in an area radially outwardly from the rotor surface 34' in comparison to a stiffness of the base 43'. This reduced stiffness area at the actuation end 44' of the vane 40' increases reliability and can also allow the use of a material having lower strength requirements in forming the vane 40'. Additionally, having the increased thickness of the vane 40' at the base 43' also allows for the wider resilient element 60 as discussed above to be utilized.

Figure 5:
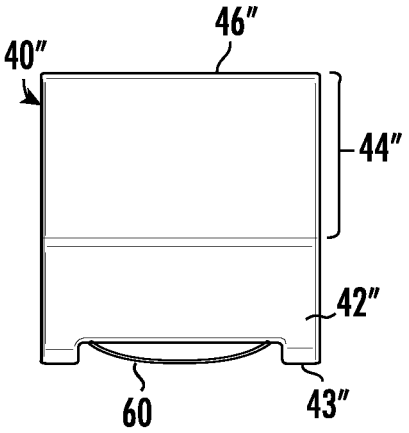
FIG. 5 is a side elevational view of the vane shown in FIG. 3.
Figure 6:
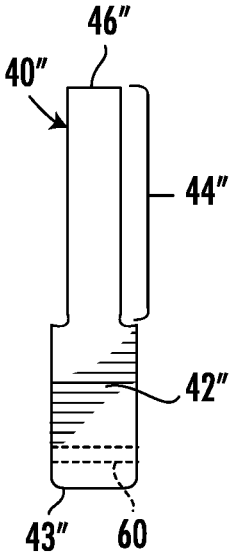
FIG. 6 is an end view of the vane shown in FIG. 3.

Referring now to FIGS. 3-6, a further embodiment of the vane 40" which can be used in the camshaft phase adjuster 10, 10' as described in connection with FIGS. 1 and 2 is shown. In this case, the vane 40" has the actuation end 44" with the cross-section having a reduced stiffness in the area that would extend radially outward from the surface 34 of the rotor in comparison to a stiffness within the groove in the rotor. In this case, the root 42" of the vane 40" has an increased thickness, preferably by at least about 30%, and more preferably at least 40%, than a thickness at the actuation end 44". Additionally, the base 43" of the vane 40" includes a recess 48" in which the resilient element 60 is received. This recess 48" ensures that the resilient element 60, preferably in the form of a bow spring as shown in FIG. 5, is held in position, and further that the resilient element 60 cannot be compressed flat. This prevents over-stressing of the resilient element 60 which can result in permanent deformation and degraded performance. The width of the resilient element 60" is approximately equal to the thickness of the root 42. Accordingly, the width of the resilient element 60" is at least about 30%, and more preferably at least 40%, greater than the thickness of the actuation end 44".

Figure 7:
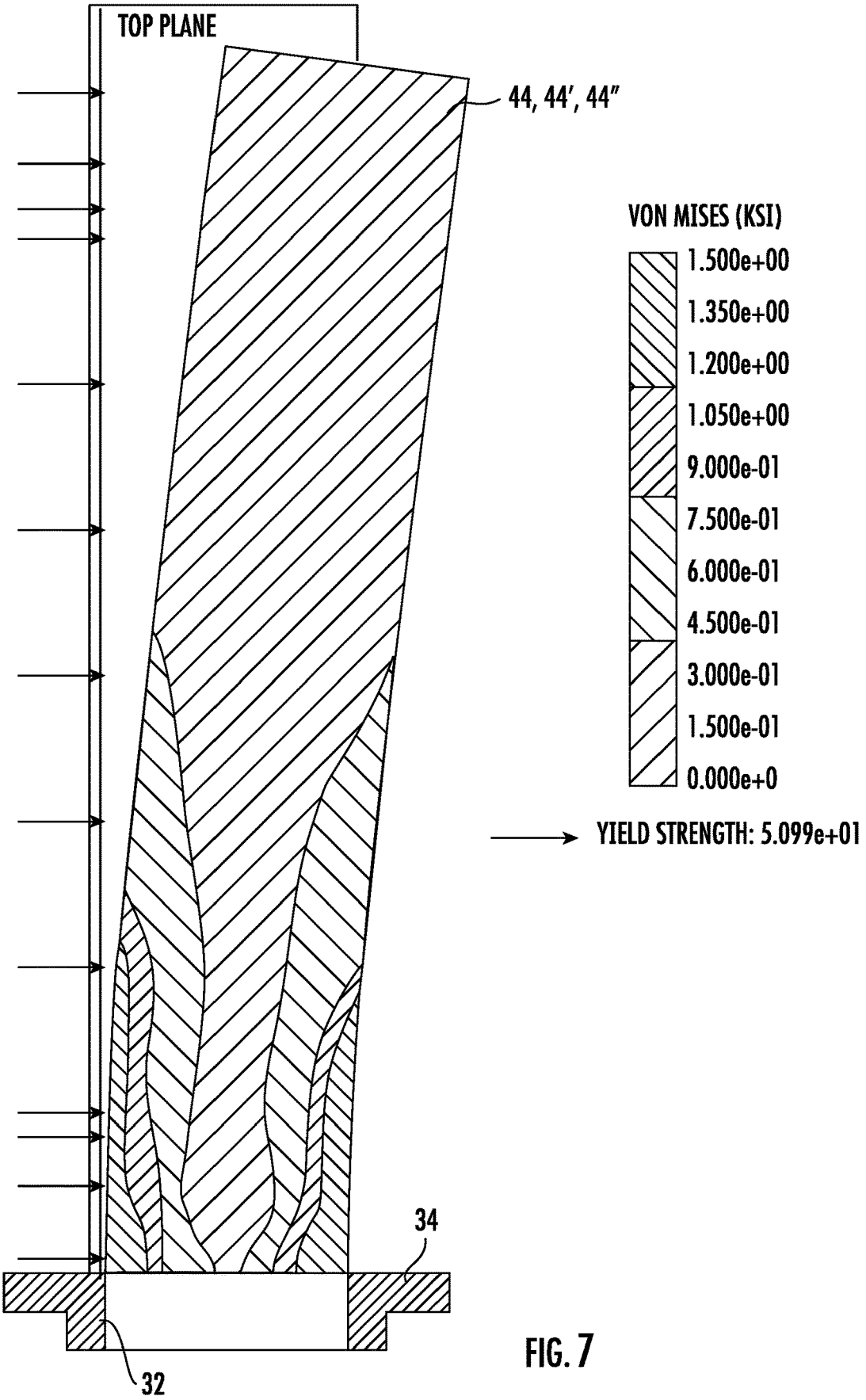
FIG. 7 is a stress diagram showing stress concentrations in a vane portion that extends from the rotor for a vane having a rectangular cross-section which is acted upon by a uniform pressurized fluid from the advancing or retarding chamber.

Referring to FIG. 7, a cross-sectional view of the actuation end 44, 44', 44" of the vane 40, 40', 40" that extends radially outward from the rotor surface 34 for the vanes 40, 40', 40" as discussed above, is shown. The actuation ends 44, 44', 44" in each case have a rectangular cross-section. Upon application of a uniform pressure force of the hydraulic fluid in the advancing or retarding chambers 50, 52 on one side of the vane 40, 40', 40", the stresses are at a highest level at an area where the vane 40, 40', 40" contacts the sides of the groove 32, 32' at the rotor surface 34. This high stress can be accommodated by proper selection of materials, typically steel, in order to provide a desired service life for the camshaft phase adjuster 10, 10'.

Figure 8:
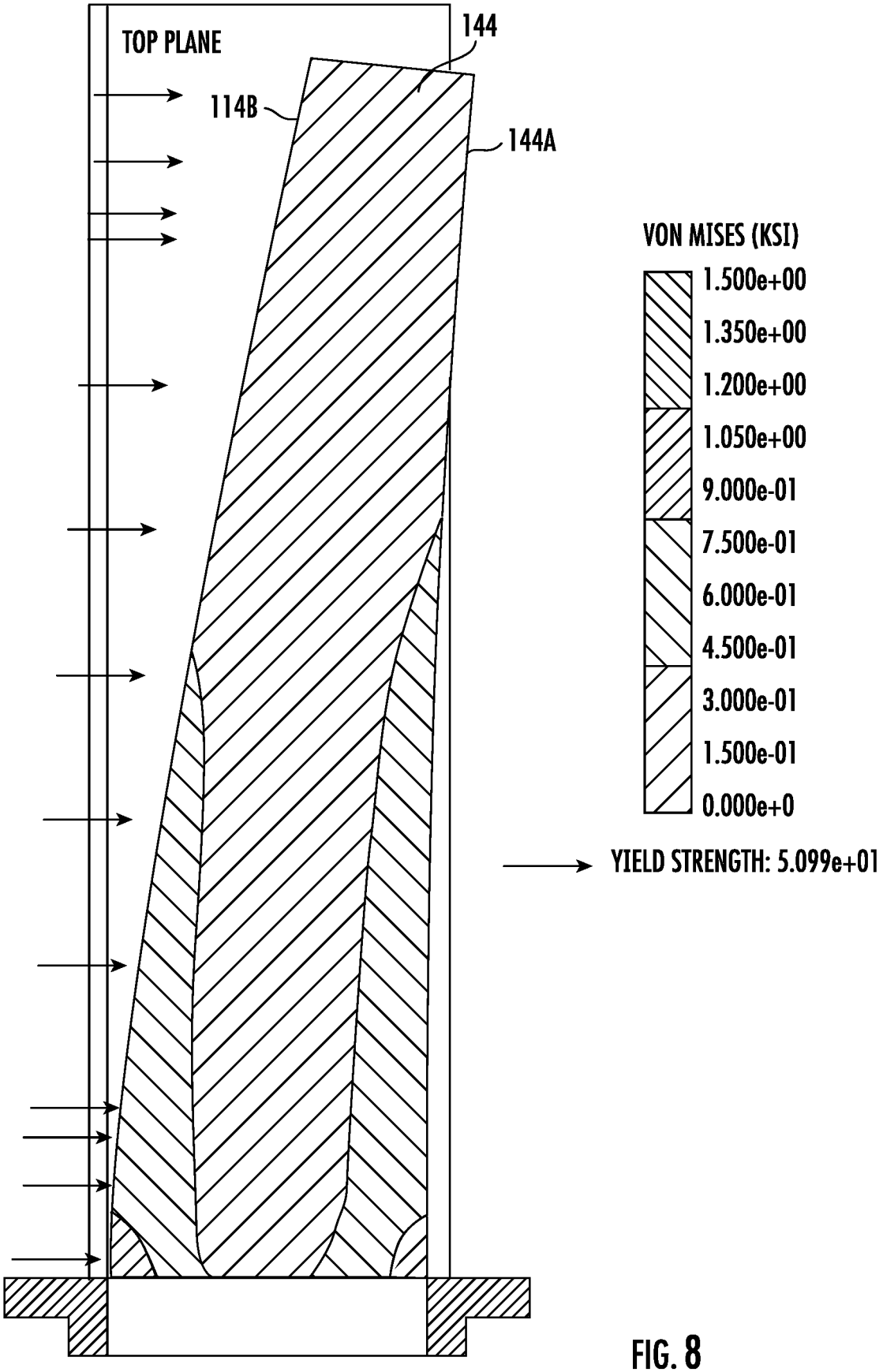
FIG. 8 is a stress diagram similar to FIG. 7 showing the stress on a vane portion that extends from the rotor for a vane having a trapezoidal cross-section which is acted upon by a uniform pressurized fluid from the advancing or retarding chamber.
Figure 9:
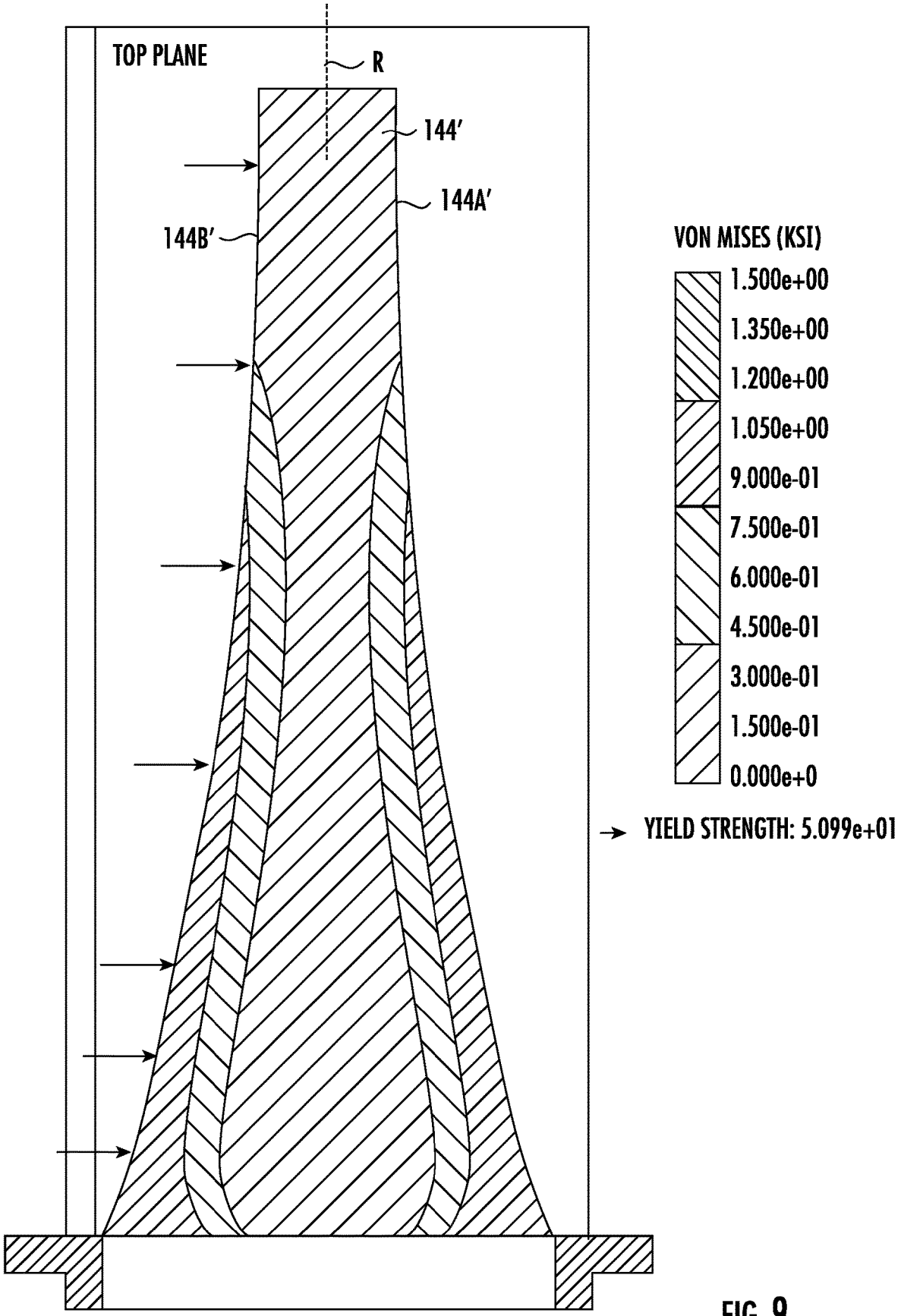
FIG. 9 is a stress diagram similar to FIGS. 7 and 8 showing the stress on a vane portion that extends from the rotor for a vane having a cross-section defined by two parabolic sides which is acted upon by a uniform pressurized fluid from the advancing or retarding chamber.

In order to improve the service life and/or allow the use of lower strength materials, as shown in FIGS. 8 and 9, it is possible to provide vanes 140, 140' in which the actuation end 144, 144' include opposing sides 144A, 144B; 144A', 144B' that face the advancing and retarding chambers 50, 52, as discussed in connection with FIG. 1, that are non-parallel. As shown in FIG. 8, these opposing sides 144A, 144B may be angled toward one another as they extend outwardly toward a radially outward tip 146 of the actuation end 144 of the vane 140. This may be a taper of the actuation end 144 that is uniform. In comparing FIG. 8 with FIG. 7, it can be seen that the stresses in the area where the vane 140 enters the groove are reduced in comparison to the rectangular cross-section shown in FIG. 7.

In order to further reduce the stress in this area, as shown in connection with the vane 140' in FIG. 9, the actuation end 144' is shown with each opposing side 144A', 144B' in the form of a symmetrical parabolic taper about a radial plane R that extends through the vane 140'. In this case, the stresses are further reduced in the area where the actuation end 144' of the vane 140' enters the groove 32.

Figure 10:
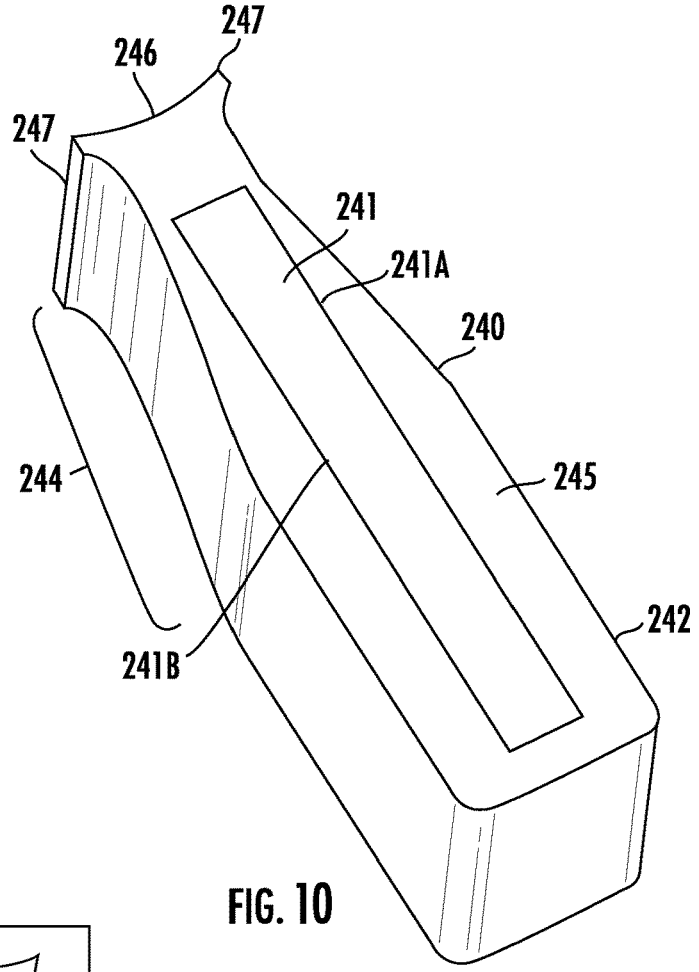
FIG. 10 is a perspective view, in cross-section, of a further embodiment of a vane for use in connection with a camshaft phase adjuster as shown in FIG. 1 formed using a metal core with an over molded polymeric cover.
Figure 11:
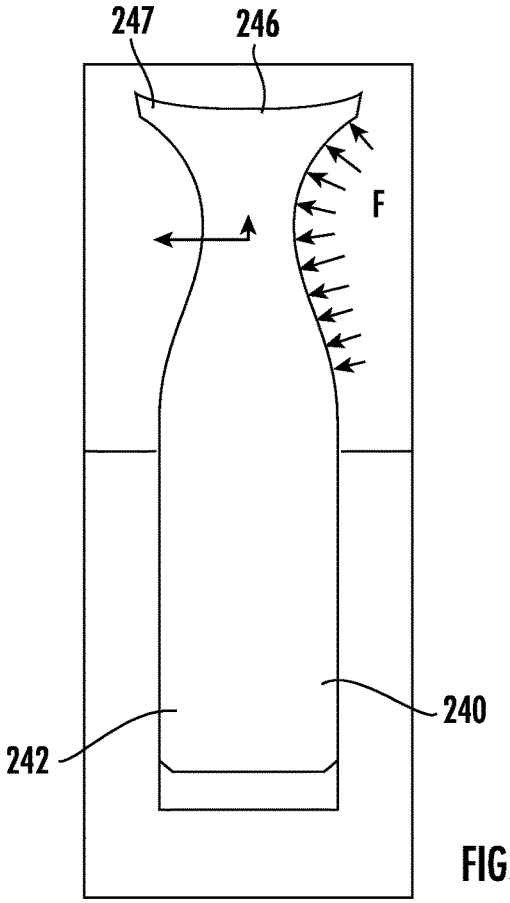
FIG. 11 is an end view of the vane of any of FIG. 10 illustrating the net hydraulic force being controllable based on a contour of the vane to create a resultant force that both advances the vane circumferentially as well as outward radially to improve sealing without relying entirely on the dynamic forces provided by engine rotation and the biasing spring.

Referring now to FIG. 10, a further embodiment of a vane 240 for use in a camshaft phase adjuster 10, for example as shown in FIG. 1, is shown. The vane 240 is formed with a core 241, for example of metal, and an outer cover 245, that is formed, for example, of an over-molded polymeric material. Here, the core 241 is formed of a first material with a higher strength than a second material used to form the outer cover 245. In one embodiment, the metal is steel and the polymeric material is PPS. However, other suitable metals may be used for the core 241 and other suitable polymers or polymer blends may be used for the cover 245 in order to achieve the desired wear and sealing properties. The core 241 also extends at least partially into the groove 32. In the embodiment of the vane 240 shown in FIG. 10, the core 241 has opposing sides 241A, 241B that are parallel. Accordingly, the core 241 has a constant thickness. Here, the over-molded polymeric material cover 245 has a constant thickness in the area of the root 242 that is received in the groove 32 in the rotor 30. However, the actuation end 244 that extends radially, outwardly from the groove 32 tapers to a reduced overall thickness in the circumferential direction as the vane 240 extends radially outward toward the region of the tip 246. At the tip 246, the outer cover 245 can have a greater thickness or area in the circumferential direction in order to form at least one sealing projection 247 that contacts the inner surface 24 of the stator 20. In the illustrated embodiment, two sealing projections 247 are shown and are integrally formed with the cover 245. This arrangement provides for enhanced sealing. Additionally, the increased thickness or area of the outer cover 245 in the region of the tip 246 can be used to enhance sealing contact of the tip 246 with the inner surface 24 of the stator 20 as it is adapted to be acted upon by the pressurized fluid in at least one of the advancing or retarding chambers 50, 52 to apply a radially outward force on the vane 240. This is illustrated with arrows F indicating the hydraulic force shown acting on the contour of the vane 240 providing both circumferential and radial force components in FIG. 11.

Figure 12:
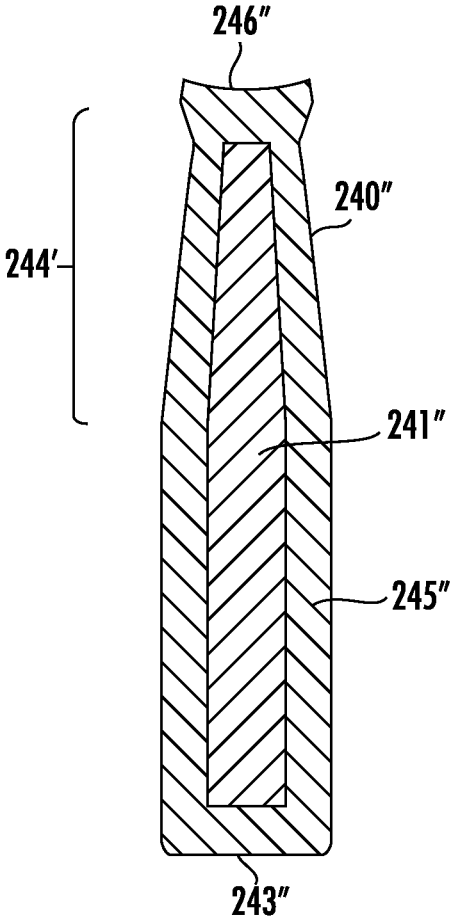
FIG. 12 is a cross-sectional view of a further embodiment of a vane similar to that shown in FIG. 10 including a metal core and an over molded polymeric cover in which the metal core is tapered in a region that extends from the rotor.
Figure 13:
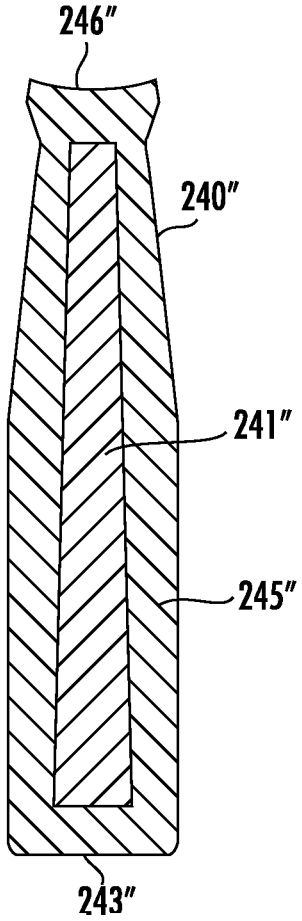
FIG. 13 is a cross-sectional view of a further embodiment of a vane similar to that shown in FIG. 12 formed with a metal core and an over molded polymeric cover in which the metal core has a straight taper from a root area that is received in the rotor out to a region of the vane tip.

Referring to FIGS. 12 and 13, two additional embodiments of the vane 240', 240" are shown. These additional embodiments of the vane 240', 240" are similar to the embodiment of the vane 240 shown in FIG. 10. Accordingly, only the differences are discussed below.

In the vane 240' shown in FIG. 12, the core 241' includes opposing sides 241A', 241B' that are non-parallel at the actuation end 244' that face, respectively, the advancing and retarding chambers 50, 52. Here, the core 241' includes a tapered portion that narrows toward the tip 246'. This arrangement allows the stiffness of the vane 240' to be adjusted more precisely in the area of the actuation end 244' that extends out from the groove 32 at the outer surface 34 of the rotor 30. The outer cover 245' is similar to the outer cover 245 discussed above, although the material of the outer cover 245' is illustrated as having a generally uniform thickness.

In the embodiment of the vane 240" shown in FIG. 13, the core 241" has a constant tapper that extends from a region of the base 243" to the region of a region of the tip 246". The outer cover 245" is similar to the outer cover 245' discussed above.

These embodiments of the vane 240, 240', 240" allow for full control over the profile shape of the vane 240, 240', 240" with enhanced wear properties due to the polymeric material contacting the mating surfaces while providing a metal core 241, 241', 241" in order to handle the loads. Further, the profile having a reduced stiffness at the actuation end 244, 244', 244" in comparison with the root 242, 242', 242" allows for more uniform load distribution and reduced peak stresses on the vanes 240, 240', 240" as well as on the rotor 30 where the vane 240, 240', 240" contacts an edge of the groove 32.

Figure 14:
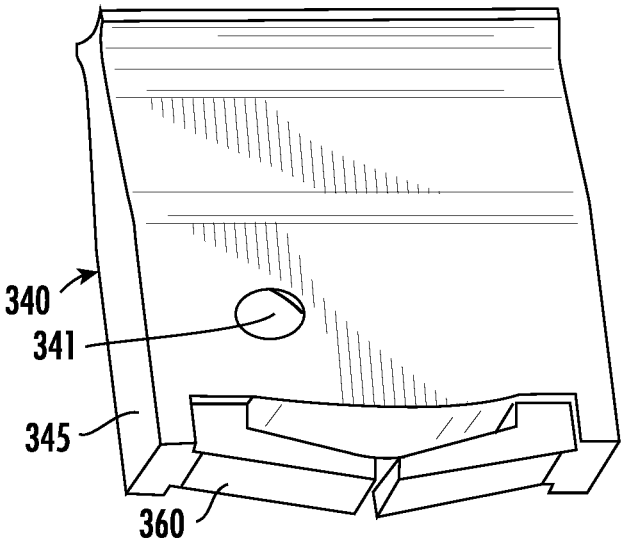
FIG. 14 is a perspective view of a further embodiment of a vane similar to the embodiments shown in FIG. 10, 12, or 13 for use in connection with a camshaft phase adjuster as shown in FIG. 1 formed using a metal core with an over molded polymeric cover and including an integrated resilient element for biasing the vane radially outwardly from the rotor.

Referring now to FIG. 14, a further embodiment of the vane 340 is shown. The vane 340 is similar to the vane 240 as discussed above and includes a core 341 as well as an outer cover 345 that are similar to the core 241 and the outer cover 245. In addition, the vane 340 includes at least one resilient element 360 that is integrally formed on the vane 340. The resilient element 360 is configured to be located in the groove 32 on the rotor 30 and biases the vane 340 radially outward into sealing contact with the inner surface 24 of the stator 20. The resilient element 360 can be formed from a polymeric material that is part of the outer cover 245. Alternatively, the resilient element 360 can be formed from a portion of the core 341 that either extends through or is coated by the outer cover 345. The vane 340 can be used in the configuration of the camshaft phaser shown in FIG. 1.

In each case, the outer cover 245, 245', 245", 345 of the vanes 240, 240', 240", 340 are formed of a polymeric material and the inner surface 24 of the stator 20 is formed of a material having a greater hardness than the polymeric material. This enhances wear properties of the camshaft phase adjuster.

Those skilled in the art that will recognize that while two sealing projections 247, 247', 247", 347 are shown in connection with the embodiments of the vane 240, 240', 240", 340 that are formed from the core 241, 241', 241", 341 having the polymeric outer cover 245, 245', 245", 345, that more or less sealing projections 247, 347 can be provided.

What is claimed is:

1. A camshaft phase adjuster, comprising:

a stator having a plurality of inwardly directed projections;

a rotor located within and rotatable relative to the stator, the rotor including a plurality of grooves therein;

a plurality of vanes, with one of the vanes being located in each respective one of the grooves, with the vanes contacting an inner surface of the stator in locations between the inwardly directed projections, and the inwardly directed projections contacting the rotor in order to define a plurality of advancing chambers and a plurality or retarding chambers;

each of the vanes including a root that is received in the respective groove and an actuation end that extends radially outwardly from the groove at a rotor surface of the rotor, with the actuation end being adapted to be acted upon by pressurized fluid in at least one of the advancing or retarding chambers; and the actuation end has a cross-section with reduced stiffness in an area radially outwardly from the rotor surface in comparison to a stiffness of the vane in the groove.

2. The camshaft phase adjuster according to claim 1, wherein the actuation end of each of the vanes includes opposing sides that face, respectively, the advancing and retarding chambers, and the opposing sides are non-parallel.

3. The camshaft phase adjuster according to claim 2, wherein the opposing sides are angled toward one as they extend outwardly toward a radially outer tip of the actuation end.

4. The camshaft phase adjuster according to claim 1, wherein the actuation end is tapered in cross-section from a region of the rotor surface to a region of a radially outer tip of the actuation end.

5. The camshaft phase adjuster according to claim 4, wherein a taper of the actuation end is uniform.

6. The camshaft phase adjuster according to claim 4, wherein a taper of the actuation end is a symmetrical parabolic taper about a radial plane extending through the vane.

7. The camshaft phase adjuster according to claim 1, wherein the vanes are formed with a core and an outer cover on the core.

8. The camshaft phase adjuster according to claim 1, wherein the core is metal and the outer cover is an overmolded polymeric material.

9. The camshaft phase adjuster according to claim 7, wherein the core includes opposing sides that are non-parallel.

10. The camshaft phase adjuster according to claim 7, wherein the outer cover includes opposing sides that are non-parallel.

11. The camshaft phase adjuster according to claim 7, wherein the outer cover is formed of a polymeric material and includes at least one sealing projection at a radially outer tip of the actuation end.

12. The camshaft phase adjuster according to claim 7, further comprising respective resilient elements integrally formed on each of the vanes, the resilient elements being located in the grooves on the rotor and bias the respective vanes radially outwardly into sealing contact with the inner surface of the stator.

13. The camshaft phase adjuster according to claim 1, further comprising a resilient element in each of the grooves that bias the respective vanes radially outwardly into sealing contact with the inner surface of the stator.

14. A camshaft phase adjuster, comprising:

a stator having a plurality of inwardly directed projections;

a rotor located within and rotatable relative to the stator, the rotor including a plurality of grooves therein;

a plurality of vanes, with one of the vanes being located in each respective one of the grooves, with the vanes contacting an inner surface of the stator in locations between the inwardly directed projections, and the inwardly directed projections contacting the rotor in order to define a plurality of advancing chambers and a plurality or retarding chambers;

each of the vanes including a root that is received in the respective groove and an actuation end that extends radially outwardly from the groove at a rotor surface of the rotor, with the actuation end being adapted to be acted upon by pressurized fluid in at least one of the advancing or retarding chambers; and each of the vanes includes a core and an outer cover on the core, the core being formed of a first material with a higher strength than a second material used to form the outer cover.

15. The camshaft phase adjuster according to claim 14, wherein the outer cover is formed of a polymeric material and the inner surface of the stator has a greater hardness than the polymeric material.

16. The camshaft phase adjuster according to claim 14, wherein the core extends at least partially into the groove.

17. The camshaft phase adjuster according to claim 14, wherein the actuation end of each of the vanes includes opposing sides that face, respectively, the advancing and retarding chambers, and the opposing sides are non-parallel.

18. The camshaft phase adjuster according to claim 14, wherein the core includes opposing sides that are non-parallel.

19. The camshaft phase adjuster according to claim 14, wherein the outer cover is formed of a polymeric material and includes at least one sealing projection at a radially outer tip of the actuation end.

20. The camshaft phase adjuster according to claim 19, wherein the at least one sealing projection is integrally molded with the outer cover.

21. The camshaft phase adjuster according to claim 14, wherein the outer cover is formed of a polymeric material and includes an enlarged surface in a region of a radially outer tip of the actuation end that extends at least partially in a circumferential direction, the enlarged surface being adapted to be acted upon by the pressurized fluid in at least one of the advancing or retarding chambers to apply a radially outward force on the vane.

22. A camshaft phase adjuster, comprising:

a stator having a plurality of inwardly directed projections;

a rotor located within and rotatable relative to the stator, the rotor including a plurality of grooves therein;

a plurality of vanes, with one of the vanes being located in each respective one of the grooves, with the vanes contacting an inner surface of the stator in locations between the inwardly directed projections, and the inwardly directed projections contacting the rotor in order to define a plurality of advancing chambers and a plurality or retarding chambers;

each of the vanes including a root that is received in the respective groove and an actuation end that extends radially outwardly from the groove at a rotor surface of the rotor, with the actuation end being adapted to be acted upon by pressurized fluid in at least one of the advancing or retarding chambers; and the root has a greater thickness in a circumferential direction than a thickness of the actuation end.

23. The camshaft phaser of claim 22, wherein the thickness of the root is at least 40% greater than the thickness of the actuation end.

24. The camshaft phaser of claim 22, further comprising a recess in the vane at a base of the root, and a resilient element located in the recess.

25. The camshaft phaser of claim 22, further comprising respective resilient elements located in each of the grooves beneath a base of the root of each of the vanes, the resilient elements biasing the vanes radially outwardly, and the resilient elements having a width that is approximately equal to the thickness of the of the root.

26. The camshaft phaser of claim 25, wherein the width of the resilient element is at least 40% greater than the thickness of the actuation end.

* * * * *